US006948455B2

(12) United States Patent
Ferguson et al.

(10) Patent No.: US 6,948,455 B2
(45) Date of Patent: Sep. 27, 2005

(54) FINNED TUBE HEAT EXCHANGER AND METHOD

(75) Inventors: Mark Allen Ferguson, Keller, TX (US); Frank Austin Myers, Mansfield, TX (US); Richard Patrick Carter, Keller, TX (US); Michael James Hubbard, Dallas, TX (US); Curtis Allan Hissam, Aledo, TX (US); Scott Kevin White, Fort Worth, TX (US)

(73) Assignee: Riverside Hydronics, LLC, Fort Worth, TX (US)

( * ) Notice: Subject to any disclaimer, the term of this patent is extended or adjusted under 35 U.S.C. 154(b) by 0 days.

(21) Appl. No.: 10/978,339

(22) Filed: Nov. 1, 2004

(65) Prior Publication Data

US 2005/0120981 A1 Jun. 9, 2005

Related U.S. Application Data

(63) Continuation-in-part of application No. 10/680,970, filed on Oct. 8, 2003, now Pat. No. 6,810,836.

(51) Int. Cl.[7] ..... F22B 23/06

(52) U.S. Cl. ..... 122/367.3; 122/367.1; 165/182

(58) Field of Search ..... 122/30, 31, 32, 122/33, 367.1, 367.3; 165/181, 182

(56) References Cited

U.S. PATENT DOCUMENTS 3,534,712 A * 10/1970 Reynolds ..... 122/225 R
4,811,696 A * 3/1989 Lacquement et al. ..... 122/4 D
6,152,086 A * 11/2000 Brouwer et al. ..... 122/249
6,644,393 B2 * 11/2003 Roberts et al. ..... 165/174

* cited by examiner

*Primary Examiner*—Gregory Wilson
(74) *Attorney, Agent, or Firm*—Charles D. Gunter, Jr.

(57) ABSTRACT

A high efficiency heat exchanger is shown which can be incorporated into a finned tube water heater. The heat exchanger has a pair of flow manifolds each having a water inlet and a water outlet and a series of connecting openings. Circular flow tubes have connecting ends which fit within the connecting openings of the manifold so that the tubes are arranged in a stacked fashion to form a tube bundle. When incorporated into a water heater, a burner communicates with the interior space within the stacked tube bundle for producing products of combustion for heating water flowing in the flow tubes. The flow tubes have external fins which are crushed to form upper and lower flat stacking surfaces for stacking the tubes to form the tube bundle. The fins are also crushed to form angled baffled surfaces about a external periphery of the tubes. The baffle surfaces serve to retain heat from the products of combustion of the burner which are released into the interior space within the stacked tube bundle. A method of corrosion protecting the heat exchanger is also shown.

24 Claims, 8 Drawing Sheets

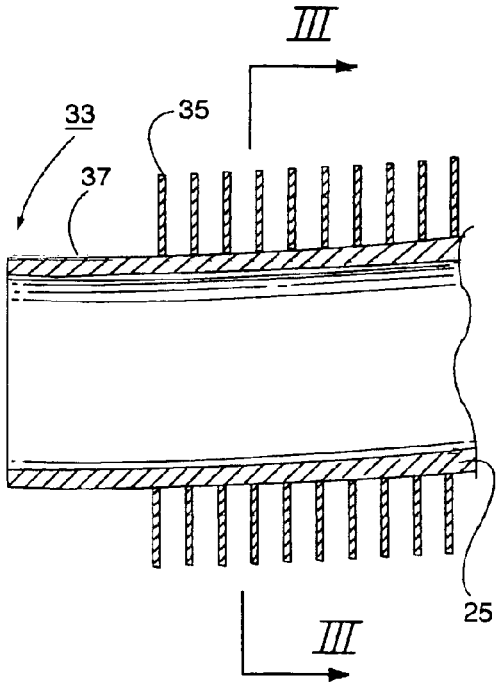
FIG.2
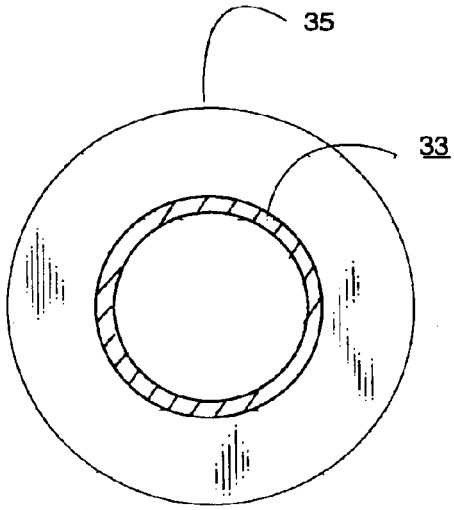
FIG.3
FIG.5
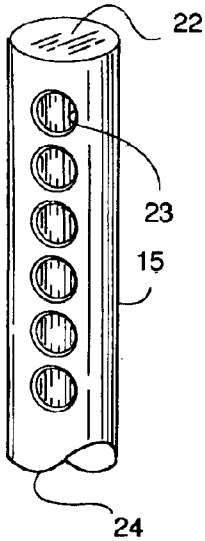
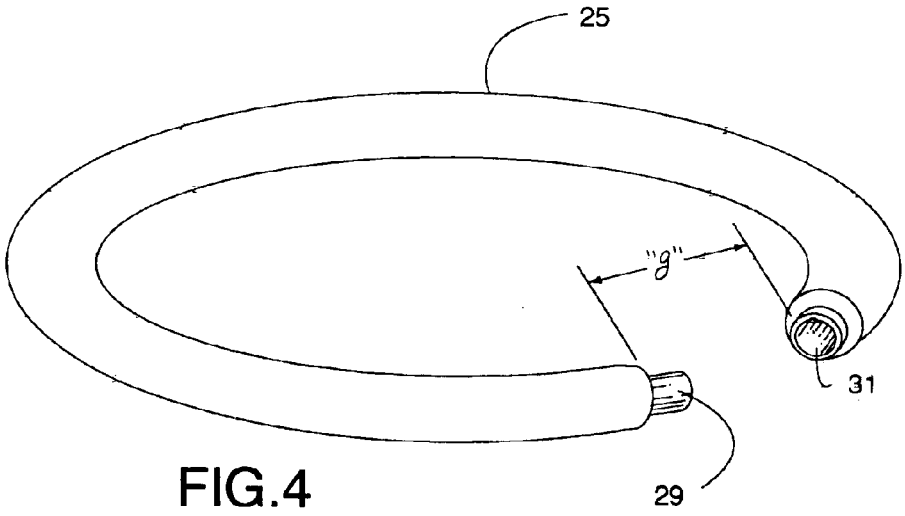
FIG.4

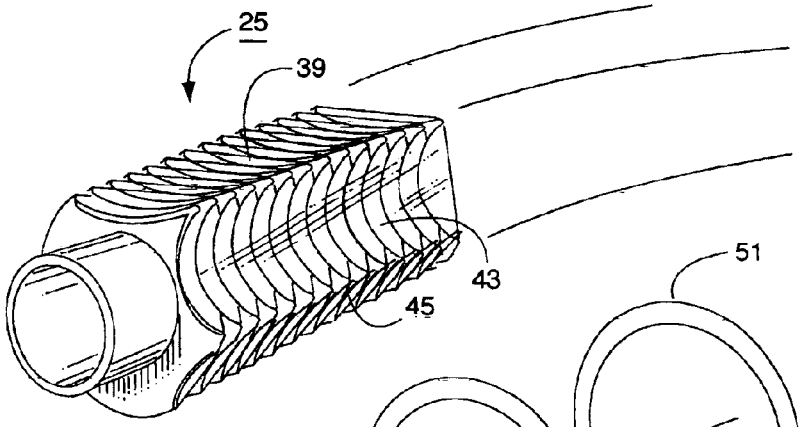
FIG.6
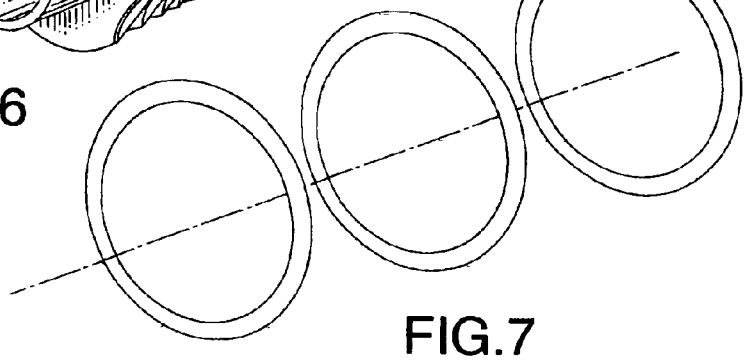
FIG.7
FIG.8
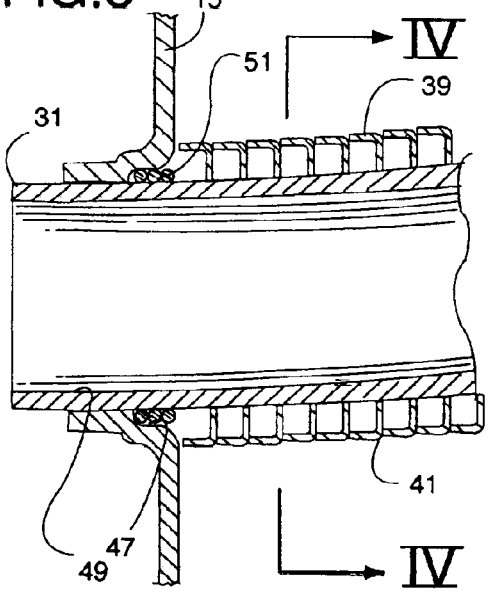
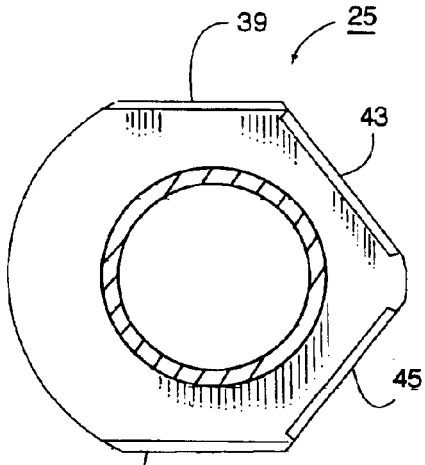
FIG.9

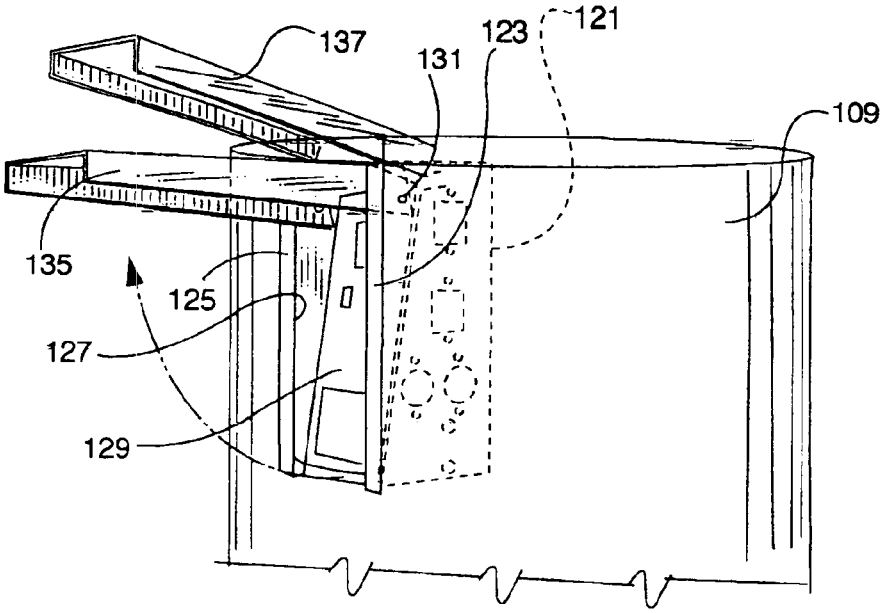
FIG.17
FIG.18
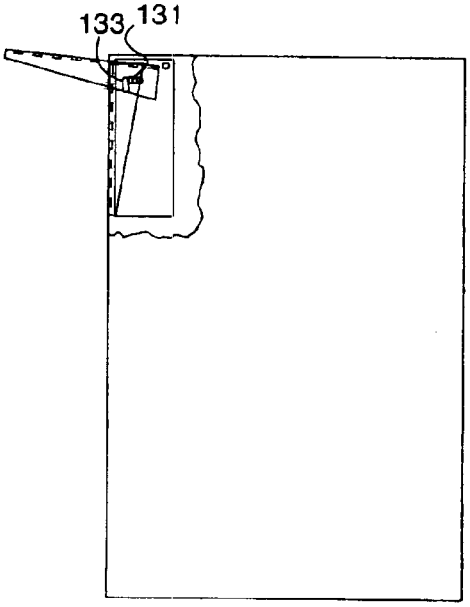
FIG.19
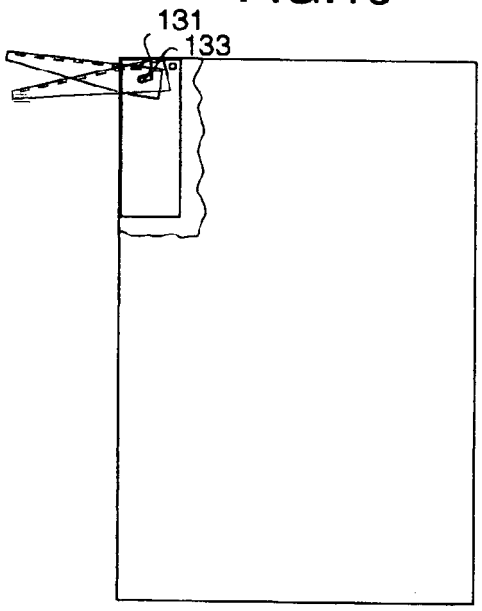

FINNED TUBE HEAT EXCHANGER AND METHOD

CROSS REFERENCE TO RELATED APPLICATIONS

The present application is a continuation-in-part of Ser. No. 10/680,970, filed Oct. 8, 2003 now U.S. Pat. No. 6,810,836, entitled "Finned Tube Water Heater", by the same inventors.

BACKGROUND OF THE INVENTION

A. Field of the Invention

The present invention relates generally to heat exchange devices and to components therefor, such devices being used in a variety of heat exchange applications including water heaters and boilers, as well as fluid heat rejection devices.

B. Description of the Prior Art

The present invention deals with heat exchange devices generally. A common example of such a device is a water heater or boiler, although as will become apparent, the principles of the invention can also be applied to other heat exchange applications. Water heaters and boilers (referred to collectively as water heaters in the discussion which follows) typically have a water heater tank, often of the vertical tube type which utilizes fire tubes located above a combustion chamber. The typical prior art gas, oil or gas/oil fired water heater featured a non-pressurized, external combustion chamber which was typically located on the bottom exterior of the water heater. Vertical shell or V-shell heat exchangers of the above type are well-known in the industry.

Water heaters of the above type generally provide for the flow of hot gas through a series of tubes mounted in vertical fashion between top and bottom support plates within the water heater tank. The products of combustion from the combustion chamber pass vertically upward through the upward interiors of the vertical tubes and out a flue outlet. Water is circulated into and out of a chamber in the prior art devices located between the tube support plates. The water contacts and circulates about the exterior of the vertical tubes to effect heat transfer to heat the water.

In U.S. Pat. Nos. 4,465,024; 4,545,329 and 4,938,204, water heater designs are shown which feature one or more submergible, pressurized combustion chambers so that all combustion takes place in the water heater tank interior in a chamber surrounded by water. These improved water heater designs featured an externally mounted, forced draft burner unit mounted on the exterior of the closed tank at a tank opening so that the burner nozzle extends in the direction of the combustion chamber for heating the combustion chamber. The resulting designs decrease heat loss and increase the thermal efficiency of the water heater many times over that which was achievable with the prior art tube and plate arrangement.

A variety of heat exchanger designs are also known which feature, e.g., coiled tube heat exchangers. In such designs as the Legend Burkay from A. O. Smith Corporation of Milwaukee, Wis., water flows through the interior of the heat exchanger tubes while hot products of combustion flow over the outside of the heat exchanger. Certain of the prior art designs in which the water flow was through the tube interior featured finned copper tubes in combination with separate baffle elements. Other manufacturers of similar products, besides A.O. Smith Corporation, include Teledyne LARS Corporation, Lochinvar Corporation, RBI Water Heaters, Ray Pak, and Patterson-Kelley Corporation.

The field of the present invention is not limited to water heater and boiler applications, although those type devices provide a convenient setting for explaining the principles of the invention. Other heat exchanger applications for the present invention include fluid heat rejection devices which feature water cooling and air heating, for example.

A need exists for an improved heat exchanger coil design which is simple in design and economical to manufacture and which exhibits improved efficiency over existing designs.

Also, despite the above noted improvements in heat exchanger, water heater and boiler designs, a need has continued to exist for an improved water heater of the finned copper tuber variety which could be produced economically and which would be effective for heating potable water for end use applications, or for heating non-potable water for the purpose of, e.g., transferring heat to an air space or to a process, such as for food or chemical processing or other similar water heater and boiler applications.

A need also exists for improvements in condensing water heater designs featuring heat exchange components of the finned copper tube variety, in which the metallic components are treated for corrosion protection in order to protect them from acidic condensation and other forms of corrosion or contamination which can damage untreated copper or cupronickel materials.

SUMMARY OF THE INVENTION

A finned tube water heater which may be used to heat water or other heat transfer fluid and may be used as a heating boiler is shown which includes at least one, and preferably two flow manifolds, each having a water inlet and a water outlet and a plurality of connecting openings. A plurality of circular flow tubes are arranged in stacked fashion to form a tube bundle which surrounds an initially open interior space. Each flow tube has a pair of opposing connecting ends which connect to selected ones of the openings provided in the flow manifolds. A burner is also provided having a burner outlet which communicates with the interior space within the stacked tube bundle for producing products of combustion for heating water flowing in the flow tubes. The flow tubes have external fins located on an exterior surface thereof. The external fins are crushed to form upper and lower flat stacking surfaces for stacking the tubes to form the tube bundle. The external fins are also crushed to form angled baffled surfaces about an external periphery of the flow tubes. The baffle surfaces serve to retain heat from the products of combustion which are released into the interior space within the stacked tube bundle.

Preferably, the external fins which are crushed to form the angled baffled surfaces on each flow tube present a continuous exposed surface on the exterior of the tube bundle when the flow tubes are stacked in vertical fashion. The continuous exposed surface comprises an integral baffle surface for the tube bundle when the tubes are stacked with the flat stacking surfaces in contact, thereby eliminating the need for a separate baffle member to assist in retaining and more uniformly distributing heat from the products of combustion in the interior space within the stacked tube bundle. In the most preferred embodiment, each finned flow tube is formed with a forming die which creates four facets on the exterior of each tube. Two of the facets form the stacking surfaces and two of the facets form the baffle surface.

In the preferred embodiment of the invention, a pair of vertically arranged flow manifolds are provided, each having connecting openings for receiving a connecting end of the finned flow tubes making up the tube bundle as previously described. The pair of vertically arranged flow manifolds have internal passageways for cross communication between the flow manifolds, whereby water enters an inlet of the first manifold of the pair and circulates through an internal passageway and through a connected flow tube to the second manifold of the pair. Each traverse of water from one manifold to the other is characterized as a "pass" and the number of passes may range from one to many. The water then circulates through an internal passageway and through a second flow tube back to the first flow manifold. The circulation continues through all of the flow tubes until the water exits an outlet of one of the selected flow manifolds. A flow control switch can be located within a selected one of the vertically arranged manifolds in-line with the flow path of water through the flow manifold.

The tube bundle is constructed by positioning at least one brazing ring about each flow tube connecting end. The brazing ring is received upon an internal landing area of the flow opening in the flow manifold for brazing the tubes to the flow manifold. Preferably, the vertically arranged manifold and connected flow tubes are brazed in an furnace as a unit in a one-step brazing operation. Preferably, the tube bundle is brazed in a furnace in an oxygen starved atmosphere at a temperature in the range of about 1400° Fahrenheit.

The tube bundle is sandwiched between a base pan and bulkhead, each of which can be provided with an insulating refractory disk for reducing heat loss through the base pan and bulkhead. The base pan and the bulkhead are joined by a plurality of connecting rods which hold the tube bundle, base pan and bulkhead in tension. In this embodiment, a one piece jacket, which can be insulated, circumscribes the tube bundle, base pan and bulkhead. The one piece jacket may be segmented to facilitate manufacture, assembly or services. The jacket seals against peripheral surfaces of the base pan and bulkhead to create a flue space when installed about the tube bundle. The flue space receives products of combustion produced by the burner. The jacket also has a flue outlet opening for exhausting products of combustion and may have an opening or openings for other piping penetrations. The one piece jacket can be held in place by a mechanical clasp and connectors, whereby the jacket is easily removable to expose the tube bundle and other components of the assembly for maintenance operations.

A blower/mixing box is mounted on an upper surface of the bulkhead. A burner retention flange is sandwiched between the blower/mixing box and the bulkhead. The blower/mixing box contains an internal scroll and an orifice member which together form a venturi passage. The internal scroll and orifice member have side tabs which are received within mating holes provided in the opposing sides of the blower/mixing box, alignment of the tabs and holes serving to provide the desired shape for the scroll within the blower/mixing box. Air and gas mixing, necessary for proper combustion, takes place within the blower/mixing box assembly, thus eliminating the need for separate down stream mixing contrivances. The blower/mixing box has an air inlet which may be fitted with an inlet damper system capable of responding to operational controls and which may provide indication of damper position. One embodiment of this inlet damper system has an internal butterfly member which is angularly positionable to control the flow of air through the assembly. The butterfly is movable between an open position for high fire conditions and a closed position for low fire conditions of the water heater, whereby the damper, in conjunction with a low and high fire valve or valves serves as a staging mechanism for the water heater.

An electrical control box with opposing sidewalls is mounted on the bulkhead. The one-piece jacket is provided with a control panel opening and a control panel is mounted within the opening. The control panel has a pair of opposing tabs at an upper end thereof which are received within mating T-slots provided in the opposing sides of the electrical control box. In this way, the control panel is positionable between a lowered positioned and an upwardly raised and locked position which provides access to electrical connections located within the electrical box. A transparent cover panel fits over the control panel within the control panel opening. The transparent cover panel is formed of a flexible plastic which allows the panel to be secured within the control panel opening by flexing the sides of the plastic material.

The gas train consists of one or more gas circuits with one or more gas valves per circuit. In one embodiment, the gas train consists of a one inch main control train for single stage models and an additional three-quarter inch control train for two-stage models. Both gas trains inject gas into the blower/mixing box where it is mixed with a combustion air supply. The combustion process is initiated by a hot surface spark or gas pilot ignitor adjacent to the burner. Desired water temperature is monitored to provide a controlling signal to turn on, control, and turn off the water heater.

The present invention also contemplates an improved finned tube heat exchanger which maybe used in other applications besides that of a water heater or boiler. The improved heat exchanger comprises at least one flow manifold having a water inlet and a water outlet and a plurality of connecting openings. A plurality of circular flow tubes are arranged in stacked fashion to form a tube bundle which surrounds an initially open interior space, each flow tube having a pair of opposing connecting ends which connect to selected connecting openings provided in the at least one flow manifold. The flow tubes have external fins located on an exterior surface thereof, the external fins being crushed to form upper and lower flat stacking surfaces for stacking the tubes to form the tube bundle. The external fins are also crushed to form angled baffle surfaces about an external periphery of the tubes when the tubes are stacked to form a tube bundle.

The circular flow tubes are preferably formed of a material selected from the group consisting of copper, aluminum, stainless steel, mild steel and cupronickel. The circular flow tubes can be provided with a corrosion resistant coating which is formed by priming an exterior surface of the flow tubes with a noble metal primer, followed by applying a corrosion protective monomeric or polymeric topcoat. The preferred noble metal is selected from the group consisting of platinum, gold, silver, electroless nickel, titanium, and alloys including Hastelloy, Inconel, Monel and Incoloy. The circular flow tubes can also first be anodized prior to applying the corrosion protective monomeric or polymeric topcoat. The preferred monomeric or polymeric topcoat can comprise a fluropolymer. The heat exchanger can be incorporated within a water heater having a burner having a burner outlet which communicates with the interior space within the stacked tube bundle for producing products of combustion for heating water flowing in the flow tubes. The heat exchanger can also be incorporated within a fluid heat rejection device having a blower having a blower outlet which communicates with the interior space within the stacked tube bundle for producing an air flow in heat exchange relationship with water being cooled as it flows through the interior of the tube bundle.

A method of corrosion protecting a finned tube heat exchanger is also shown which includes the steps of providing a heat exchanger having:

a pair of flow manifolds, each having a water inlet and a water outlet and a plurality of connecting openings;

a plurality of circular flow tubes arranged in stacked fashion to form a tube bundle which surrounds an initially open interior space, each flow tube having a pair of opposing connecting ends which connect to selected connecting openings provided in a selected one of the flow manifolds; and wherein the flow tubes have external fins located on an exterior surface thereof, the external fins being crushed to form upper and lower flat stacking surfaces for stacking the tubes to form the tube bundle, the external fins also being crushed to form angled baffle surfaces about an external periphery of the tubes, the angled baffle surfaces on each flow tube presenting a continuous exposed surface on the exterior of the tube bundle when the flow tubes are stacked in vertical fashion which comprises an integral baffle surface for the tube bundle; and wherein the circular flow tubes are formed of a material selected from the group consisting of copper, aluminum, stainless steel, mild steel and cupronickel; and wherein the circular flow tubes are provided with a corrosion resistant coating which is formed by priming an exterior surface of the flow tubes with a noble metal primer, followed by applying a corrosion protective monomeric or polymeric topcoat.

The preferred noble metal is selected from the group consisting of platinum, gold, silver, electroless nickel, titanium, and alloys including Hastelloy, Inconel, Monel and Incoloy. The preferred monomeric or polymeric topcoat can comprise a fluropolymer.

Additional objects, features and advantages will be apparent in the written description which follows.

BRIEF DESCRIPTION OF THE DRAWINGS

FIG. 2 is a side, cross-sectional view of a finned tube prior to being formed in the forming process of the invention.

FIG. 3 is an end view taken along lines III—III in FIG. 2.

FIG. 4 is a perspective view of one of the circular flow tubes which has been formed in the forming process of the invention.

FIG. 5 is a partial view of one of the vertically arranged flow manifolds showing the openings which receive the connecting ends of the circular flow tubes.

FIG. 6 is a partial, perspective view of one of the formed flow tubes showing the crushed fins thereof.

FIG. 7 is an isolated view of three brazing rings which are positioned on the connecting end of the flow tube of FIG. 6.

FIG. 8 is a side, partial cross-sectional view of a portion of the vertical flow manifold showing one opening thereof with the connecting end of flow tube inserted in the opening and with the brazing rings positioned on the landing of the opening.

FIG. 9 is an end view of the flow tube of the invention showing the crushed fins which form the stacking surfaces and the angular baffled surfaces thereof.

FIG. 17 is a simplified, isolated view of the control panel which is located within the control panel opening of the electrical control box.

FIGS. 18 and 19 illustrate the movement of the control panel within the mating T slots provided in the opposing sidewalls of the electrical control box of the assembly.

DETAILED DESCRIPTION OF THE INVENTION

It will be understood from the description which follows that the finned tube heat exchanger of the invention may be utilized in a variety of applications including water heaters and boilers as well as, for example, fluid heat rejection devices in which water passing through the device is being cooled and air passing in heat exchange relationship is being heated. The water heater application provides a convenient illustration of the principles of the invention, however.

Figure 1:
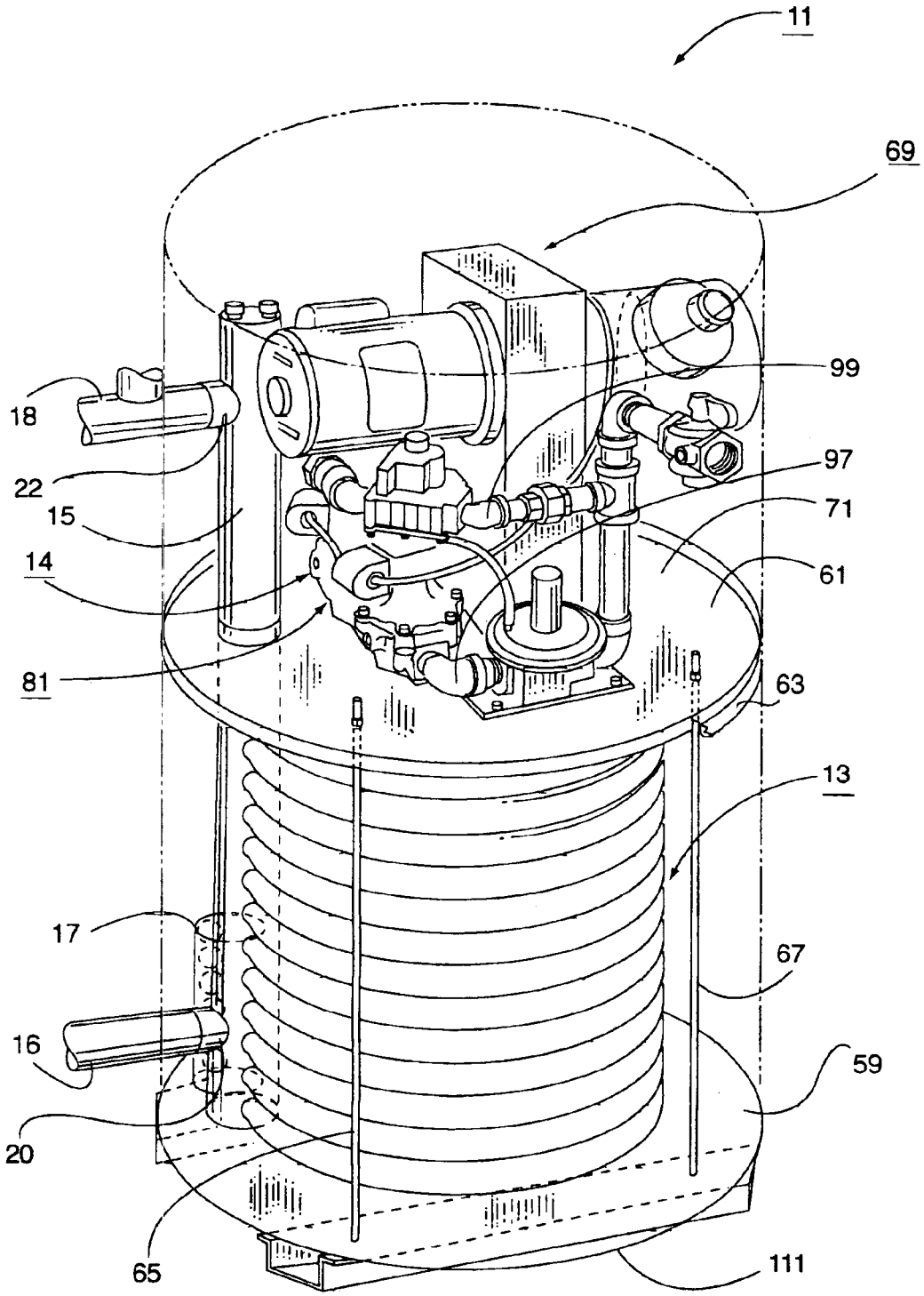
FIG. 1 is a perspective view of the finned tube water heater embodiment of the invention with the outer removable jacket shown in phantom lines

FIG. 1 thus shows a finned tubed water heater of the invention designated generally as 11. The water heater 11 includes a heat exchanger or "tube bundle assembly", designated generally as 13, and a gas delivery and firing section, designated generally as 14. The tube bundle assembly will typically be formed of copper, but in some embodiments of the invention may be formed of aluminum, stainless steel, mild steel and cupronickel. The tube assembly 13 is shown in isolated fashion in FIG. 10. The tube bundle assembly preferably includes at least two perpendicular flow manifolds 15, 17, which, in this case, are arranged in a vertical configuration. The flow manifolds 15, 17 are "perpendicular" to the circular flow tubes 25. In some embodiments of the invention, however, the flow manifolds may be arranged in horizontal fashion, as if the unit 11 were tipped on its side. Also, while the manifold 15 is taller than the manifold 17 in FIG. 1, appliances may also be designed with identical height manifolds. One of the two manifolds 15 has a water inlet 19 and a water outlet 21. FIG. 5 shows a portion of one of the vertically arranged flow manifolds 15, the manifold having a plurality of connecting openings 23. The manifold 15 also has oppositely arranged closed ends 22, 24. The closed ends 22, 24 together with metal caps or disks brazed to an outer or inner surface of the flow manifolds, form dividers for the flow of water in alternate flow paths, as will be described in greater detail.

Figure 11:
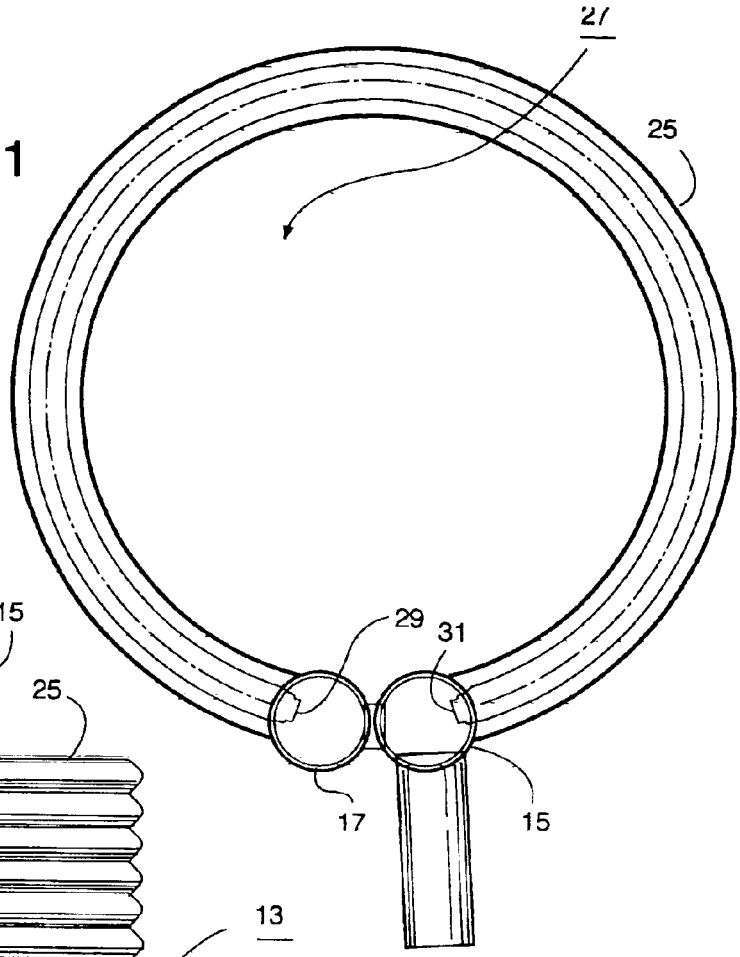
FIG. 11 is a top view of the tube bundle showing the connecting ends of the flow tubes within the vertically arranged flow manifold.

A plurality of circular flow tubes (25 in FIGS. 10 and 11) are arranged in stacked fashion to form the tube bundle which surrounds an initially open interior space (27 in FIG. 11). As shown in FIG. 4, each flow tube 25 is "circular" in the sense that it is an incomplete arc of a circle, the opening or gap ("g" in FIG. 4) allowing the flow tube to be connected to the flow manifolds (see FIG. 11). Each flow tube has a pair of opposing connecting ends (29, 31 in FIGS. 4 and 11) which connect to the openings provided in the flow manifolds 15, 17.

With reference to FIGS. 2–9, the circular flow tubes 25 are initially provided as straight finned tubes having the cross-sectional structure illustrated in FIGS. 2 and 3. FIG. 2 shows the fins 35 which circumscribe the tube 25 and which are arranged in a plane generally perpendicular to the exterior surface 37 of the tube. The straight finned tube 25 is then fed through a rolling or forming die (not shown) which crushes the external fins in a predetermined pattern. In the particular example illustrated, a ⅞ inch finned copper tube is formed into a twenty inch diameter circle with the fins formed to create an angular baffle surface around the outer circumference. In the most preferred form of the invention, the external fins 35 are crushed in the forming die to form upper and lower flat stacking surfaces (39, 41 in FIG. 9) for stacking the tubes to form the tube bundle. The external fins are also crushed to form angled baffle surfaces 43, 45 about an external periphery of the tubes.

Figure 10:
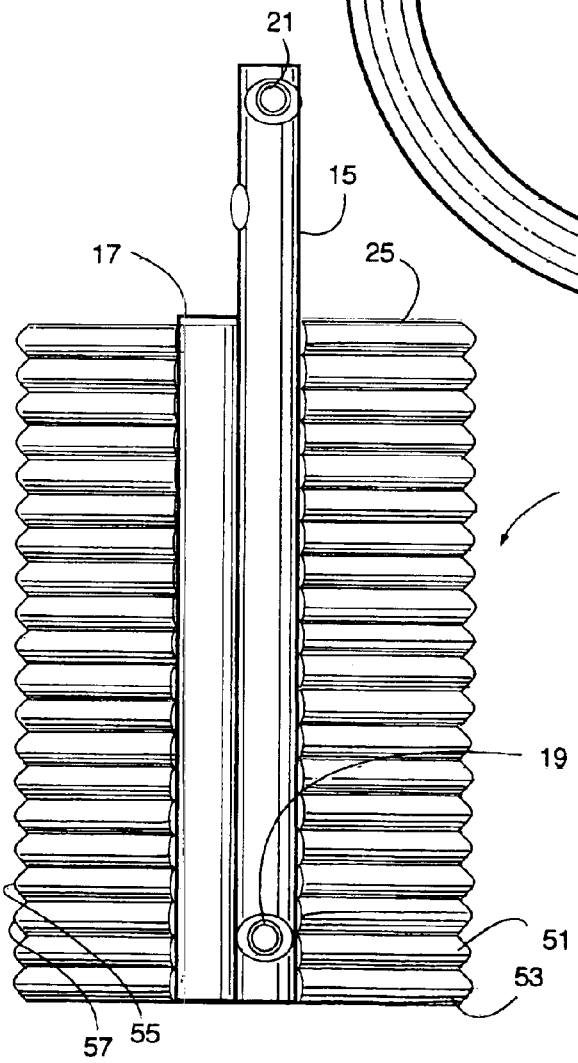
FIG. 10 is an isolated view of the tube bundle of the invention showing the vertically arranged flow manifolds and the circular flow tubes making up the tube bundle.

As shown in FIGS. 6 and 10, the external fins of the flow tubes 25 which are crushed to form the angled baffled surfaces on each flow tube present a continuous exposed surface on the exterior of the tube bundle 13. When the flow tubes are stacked in vertical fashion, the continuous exposed surface comprises an integral baffle surface for the tube bundle with the flat stacking surfaces 39, 41 (FIG. 9) in contact, thereby eliminating the need for a separate baffle member to assist in retaining and more uniformly distributing heat from the products of combustion in the interior space 27 (FIG. 11) within the stacked tube bundle 13. In the most preferred form of the invention, each finned flow tube 25 is formed with a forming die which creates four facets (39, 41, 43, 45 in FIG. 9) on the exterior of each tube. Two of the facets 39, 41 form the stacking surfaces and two of the facets 43, 45 form the baffle surface.

As best seen in FIG. 8, each of the vertically arranged flow manifolds 15 has a flow opening (23 in FIG. 5) for receiving the connecting end 31 of the finned flow tubes. Rather than using a T-drill or round hole puncher, the flow openings 23 are machined or punched with tooling to provide an oval opening having a particularly preferred shape. Each of the openings is preferably formed having a circumferential landing area (47 in FIG. 8) which leads to an internal draw region 49. At least one brazing ring of filler metal and preferably three brazing rings (51 in FIG. 7) are positioned about each flow tube connecting end. The brazing rings are received upon the internal landing area 47 of the flow opening for brazing the tubes to the flow manifold when the tube connecting end 31 is positioned as shown in FIG. 8. Once the filler metal (brazing ring) is preplaced, the assembly is then furnace brazed in an oxygen starved environment at a temperature of a approximately 1400° Fahrenheit. Other brazing furnaces and techniques can also be utilized in addition to the described preferred brazing method. In addition to brazing rings, other braze filler metal such as brazing paste, brazing strips/foil, cast braze filler metal, etc., can be utilized. Preferably, liquid nitrogen is injected into the furnace to shield the copper of the tube bundle assembly from oxidation and to provide rapid cooling of the assembly. With reference to FIGS. 1 and 10, it is important to note header pipes (16, 18 in FIG. 1) may be hand brazed at the joints 20, 22.

In the completed tube bundle assembly as shown in FIG. 10, each of the flow manifolds 15, 17 has connecting openings for receiving a connecting end 29, 31 of the finned flow tubes making up the tube bundle. The pair of vertically arranged flow manifolds 15, 17 have internal passageways (not shown) for cross-communication between the flow manifolds. In this way, for example, water enters the inlet 19 in the flow manifold 15 and passes through a connected flow tube or tubes such as tubes 51, 53 to the second manifold 17. The water then passes through an internal passageway (not shown) in the second manifold 17 and out flow tubes 55, 57 back to the first manifold. The circulation continues through all of the flow tubes until the water exits the outlet 21 of the first flow manifold.

Although the preferred tube bundle assembly has a pair or vertically arranged flow manifolds 15, 17, a heat exchanger arrangement can also be visualized in which only a single flow manifold is utilized. With reference to FIG. 10, one can visualize the vertical flow manifolds 15, 17 being combined as a single vertical flow manifold having connecting openings, as has been described, for the connected flow tubes. The single vertical flow manifold would have a series of internal walls or baffles which would create flow passages for directing the water from the inlet 19 to the outlet 21.

As best seen in FIG. 1, the tube bundle assembly 13 is sandwiched between a base pan 59 and a bulkhead 61, each of which can be provided with an insulating refractory disk or lining (shown broken away as 63 in FIG. 1) for insulating the tube bundle. The base pan 59 and the bulkhead 61 are joined by a plurality of threaded connecting rods (65, 67 shown in FIG. 1) which hold the tube bundle, base pan and bulkhead in tension. In this way, the tube bundle assembly can be provided in a "package fashion" for subsequent maintenance or replacement operations.

Although the preferred device is described with reference to the use of insulating refractory disks to seal the ends of the heat exchanger, the refractory disks could be replaced by a pumped water cavity or a series of tubes. This would help to minimize heat loss, increase the heat transfer and minimize or eliminate the use of refractory.

Figure 14:
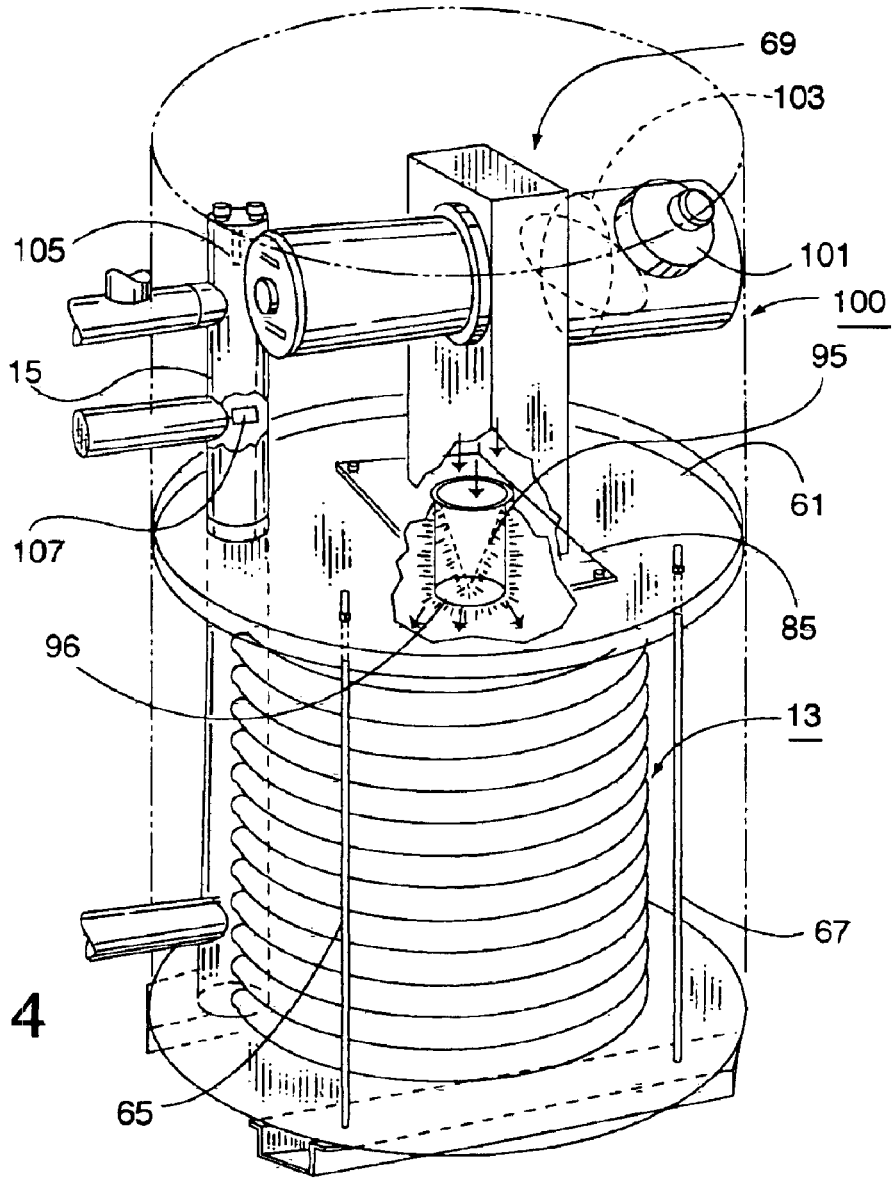
FIG. 14 is a simplified, perspective view of the water heater assembly with portions removed for ease of illustration and showing the burner located within the blower/mixing box assembly.
Figure 15:
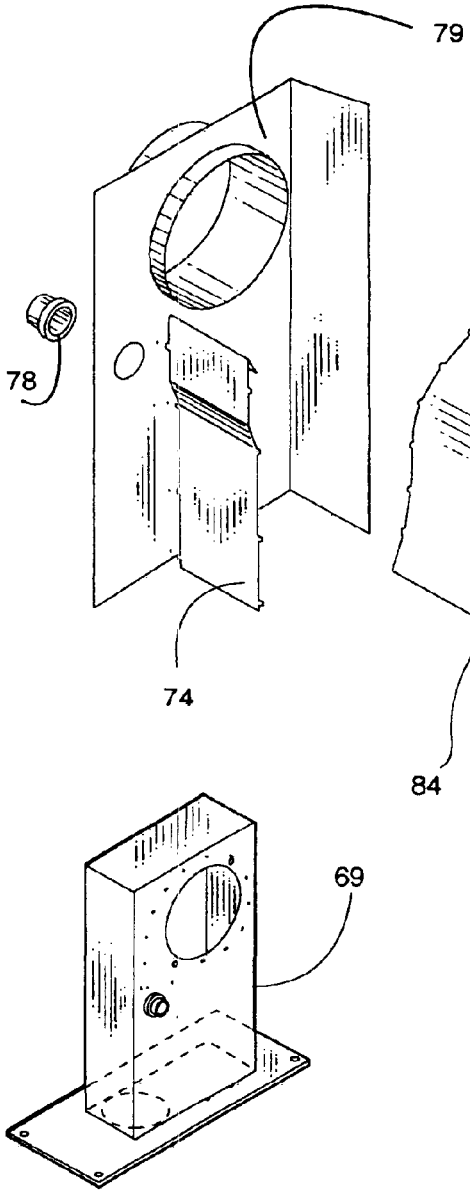
FIG. 15 is an isolated view of the blower/mixing box.
Figure 16:
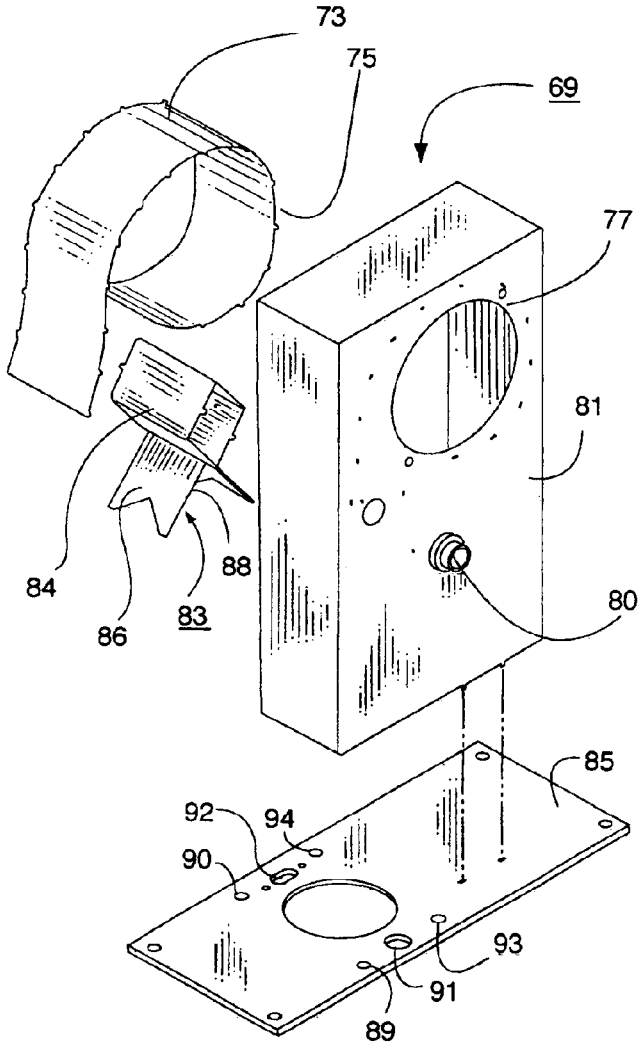
FIG. 16 is a view of the mixer box in exploded fashion showing the internal components thereof.

As shown in FIGS. 1, 14 and 15, a blower/mixing box 69 is mounted on an upper surface (71 in FIG. 1) of the bulkhead. FIGS. 15 and 16 show the blower/mixing box in isolated and exploded fashion, respectively. The blower/mixing box 69 contains an internal scroll 73 which has a plurality of side tabs 75 which are received within mating holes 77 provided in the opposing sides 79, 81 of the blower/mixing box 69. Alignment of the tabs and holes serves to provide the desired shape for the scroll and allows assembly within the blower/mixing box. The assembly also includes an orifice element 83. The orifice element 83 has a polygonal upper extent 84 and downwardly extending flanges 86, 88. The orifice element 83 sits behind the gas ports 78, 80. Upon assembly, the orifice element 83 together with the scroll 73 forms a venturi shaped passageway within the blower/mixing box.

The preferred burner illustrated in the drawings has a generally cylindrical exterior surface which is formed of a woven metal fabric. The burner also has a conically tapered interior, as shown in FIG. 14. Other burner styles can also be utilized, if desired. Such burners include those having a woven metal fabric covered tubular burner, with an internal distributor that is not conical in shape, in addition to burners which have neither a conical tapered center nor a woven metal cover. Thus, the burner could be a punched port, porous mat, porous or ported ceramic or woven metallic mat, with properly sized air fuel passageways or porosity and with a conically tapered, variable airfoil or ported air/fuel distribution system.

As shown in FIG. 16, the blower/mixing box 69 is received upon a planar base member 85. The base member 85 acting as a strengthening member to hold the bulkhead 61 flat when assembled as shown in FIGS. 1 and 14. The exposed flange region of the base member 85 and holes 89, 91, 93 serve as a mounting surface for the ignition source (generally at 81 in FIG. 1). The oppositely arranged holes 90, 92, 94 are provided for mounting a sight glass (not shown). A fiberglass ceramic gasket fits between the base member 85 and the bulkhead and clamps the sight glass assembly in place.

A burner (95 in FIG. 14) has a burner outlet 96 which communicates with the interior space 27 within the stacked tube bundle for producing products of combustion for heating water flowing in the flow tubes. As shown in FIG. 14, the burner 95 is inserted into bulkhead 61 where it is surrounded by and concentrically located within the tube bundle assembly 13. High temperature gaskets of material such as glass fiber or refractory are used to seal the burner 95 to the bulkhead and the blower assembly to the burner.

The gas train and ignition system will now be described in terms of one preferred embodiment of the invention, namely a two stage unit with hot surface ignition. However, it will be appreciated from the discussion which follows, that units may also be manufactured with single stage operation, full range air/fuel modulation, and with alternate flame ignition means such as direct ignition or spark pilot.

In the preferred embodiment of the device shown in FIG. 1, the gas train consists of a one inch main control train 97 and a three-quarter inch control train 99 for two stage water heater operation. Both gas trains inject gas into the blower/mixing box 69 where it is mixed with the combustion air supply. As shown in FIG. 14, the blower/mixing box 69 has an air inlet 100 which is fitted with an air inlet damper 101. The damper 101 has an internal butterfly member 103 which is angularly positionable to control the flow of air through the assembly. The butterfly 103 can be moved angularly between a fully open position for high fire conditions and a fully closed position for low fire conditions of the water heater. The air damper in the preferred embodiment is described as being a butterfly which is used for staging. The butterfly 103 can also be an operative element which takes another convenient shape for controlling the air or air/fuel flow. Thus, the butterfly may assume a variety of shapes and may be used for staging or modulation.

The combustion process in initiated by a hot surface ignitor adjacent to the burner and is monitored by appropriate electrical controls. In use, the damper acts as a switch mechanism. The second stage will only fire if on high flame. The second stage then fires and begins to increase the internal temperature. When the process temperature reaches a first set point, the damper butterfly closes. This action cuts off the air supply (except for leakage around the damper) and a gas valve shuts off to the high side. Only the low side gas is now being admitted. As demand increases, the damper opens to again turn on the high side. In this way, the damper serves as a staging mechanism for the water heater. The water temperature is monitored at the inlet of the flow manifold by means of a temperature sensor 105 (FIG. 14). A flow control switch, such as paddle 107 in FIG. 4, is located within a section of the vertically arranged manifold 15 in-line with the flow path through the flow manifold and is furnace brazed in position during the brazing of the tube bundle assembly. This eliminates any labor associated with pipe fittings downstream of the flow manifold 15.

While a preferred embodiment of the control system has been described, other traditional blower and control systems may be utilized, as well. For example, in another embodiment, the inlet damper controls the flow of air through the assembly by means of a movable restrictor plate, tube or member whose area is increased or decreased. This variable damper, in conjunction with a variable gas valve or valves, serves as a modulation mechanism for the water heater. The amount of gas released by the gas valve is proportional to the amount of combustion air drawn into the blower inlet. The air and gas are unifromly mixed in the blower of the blower mixing box. The combustion process is initiated by a hot surface igniter, electrical spark or gas pilot igniter adjacent to the burner. The desired water temperature is monitoried to provide a controlling signal to turn the water heater up, down, or off.

Figure 12:
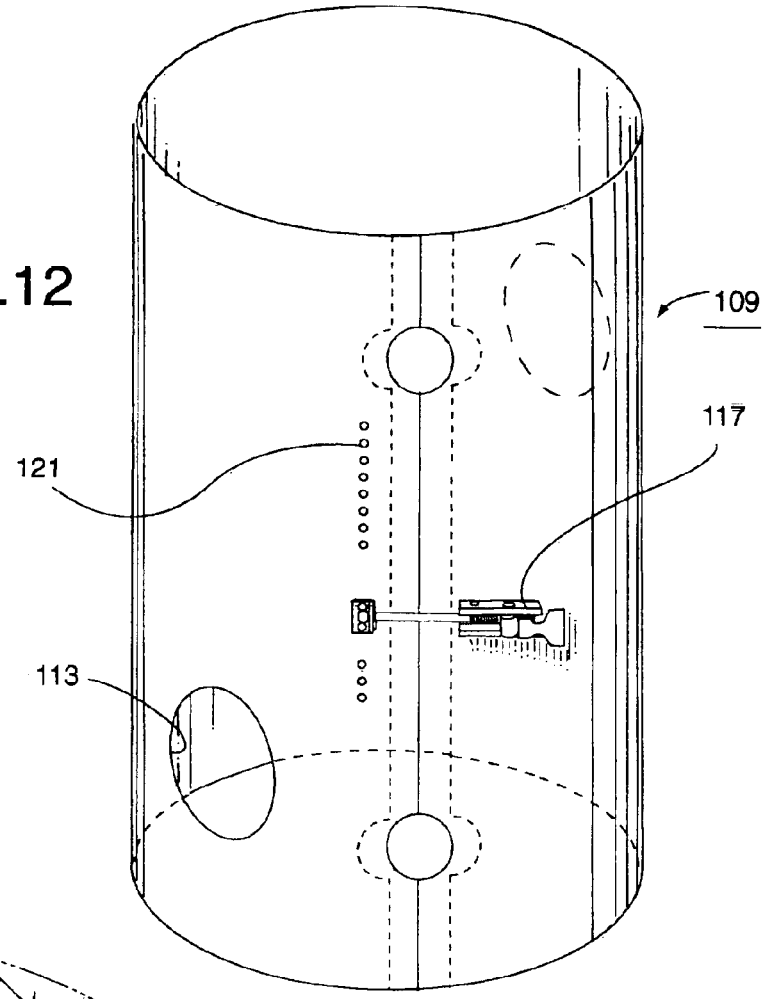
FIG. 12 is an isolated view of the removable jacket for the water heater of the inanition.
Figure 13:
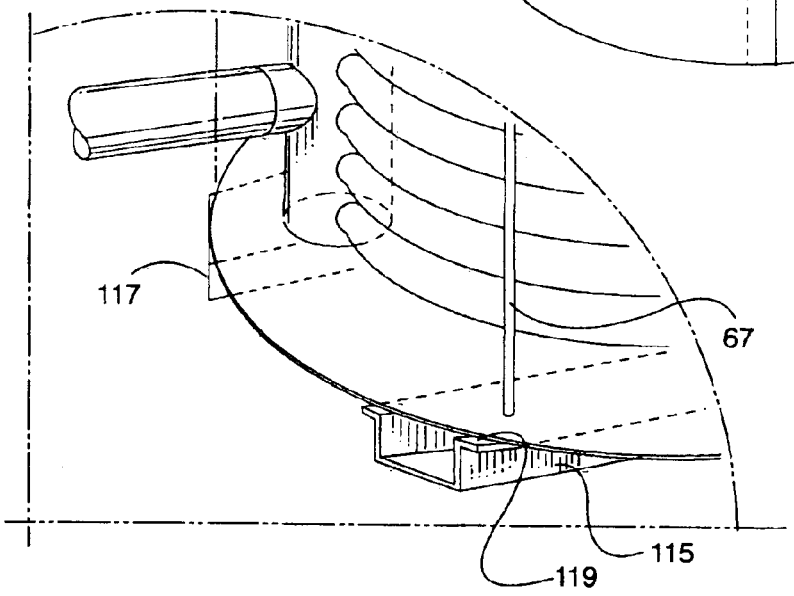
FIG. 13 is a simplified partial view of the lower portion of the assembled water heater showing the removable jacket supported upon the horizontal runners of the assembly.

As shown in FIGS. 12 and 13, the water heater also includes a one-piece jacket 109 which can be insulated or uninsulated. The jacket 109 circumscribes the tube bundle 13, base pan 59 and bulkhead 61 and seals against peripheral surfaces thereof, such as surface 111 in FIG. 1, to thereby form a flue space when installed about the tube bundle. The flue space receives products of combustion produced by the burner. The jacket also has flue outlet opening 113 for exhausting products of combustion through a flue outlet conduit (not shown).

As shown in FIG. 13, the one-piece jacket 109 is held in place initially by a mechanical clasp 115, whereby the jacket is easily installed and removable to expose the tube bundle and other internal components for maintenance operations by opening the mechanical clasp. In the preferred method of assembly, a pair of runners (115, 116 in FIG. 13) are provided beneath the base pan 59 and extend beneath the base pan in order to support the base pan. The runners each have an exposed length 119 which also serves to support the one-piece insulated jacket 109 as the jacket is being installed about the tube bundle. Once the jacket has been drawn up tight by means of the mechanical clasp 115, a series of mechanical connectors, such as threaded screws 121, can further be installed to secure the jacket in position. To remove the jacket and completely expose the internal components, it is only necessary to unscrew the screws 121 and detach the clasp 115.

As shown in FIG. 17, an electrical control box with opposing sidewalls 123, 125 is mounted on the bulkhead 61. The one-piece jacket 109 is provided with a control panel opening 127. A control panel 129 is mounted within the opening. The control panel 129 has a pair of opposing tabs (131 shown in FIGS. 17–19) at an upper end thereof which are received within mating T slots 133 provided in the opposing sidewalls of the control box. In this way, the control panel is positionable between a lowered position (shown in phantom lines as 129 in FIG. 17) and an upwardly raised and locked position indicated as 135 in FIG. 17. The upwardly raised position provides access to the electrical components located within the electrical control box in case of maintenance or other operational needs.

A transparent cover panel 137 fits over the electrical control panel within the control panel opening. The transparent cover panel 137 is formed of a flexible plastic material which allows the panel to be secured within the control panel opening 127 by flexing the sides of the plastic material and inserting the transparent cover within the opening. The cover can then be retained by tension within the opening 127 or can be secured with a screw or other fixture.

The firing operation will now be briefly described with respect to one preferred embodiment of the invention using hot surface ignition. The operating thermostat senses a return water temperature below a first set point and the operating circuit is energized. If no intervening control device opens the circuit, such as an energy management system, the combustion control will be energized. The flame control checks for an open safety proving circuit and if an open condition exists, the ignition sequence will begin. The flame control begins by energizing the blower circuit and subsequently checking the safety proving circuit for a positive air, water pressure, overfire and flue conditions. When the safety circuit has been proved and a 15 second pre-surge is complete, the warm-up period begins. When the ignitor current reaches the acceptable threshold, the valve circuit will energize and ignition of the main flame occurs. The presence of the flame is continuously monitored by flame rectification through the hot surface igniter. If the flame is lost or fails to ignite the system will retry for three attempts before locking out and requiring reset. In the case of the two stage construction firing cycle, the two stage operating control will open and close the inlet dampers so as to stage the burner between high and low fire conditions. The damper then stages the second stage (main gas train) while leaving the first stage operational until the system water temperature exceeds the first set point on the operating control. When the demand for heat has ended, the flame control will de-energize the valve circuit and allow the combustion air blower to operate for a post purge period of about 30 seconds.

The improved heat exchanger or tube bundle 13 has been described with respect to a preferred embodiment of its use as the heat exchange element of a finned tube water heater or boiler. However, other applications for the improved heat exchanger can also be easily visualized. For example, with reference to FIG. 1 of the drawings, one can easily visualize the heat exchanger tube bundle 13 being used in a fluid heat rejection device used for water cooling and air heating. In such an embodiment of the invention, hot water would be introduced into the tube bundle through the inlet 19 and cooled water would pass out the exit 21 (FIG. 10). The burner gas delivery and firing section 14 would be replaced with a commercially available blower which would be used to introduce a stream of air in heat exchange relationship with the tubes by forcing the air through the open interior space (27 in FIG. 11) of the tube bundle. If desired, a cooling water cascade could be pumped across the coils of the tube bundle to increase heat transfer.

The preferred water heater of the invention has been described in a non-condensing embodiment. In other embodiments of the invention, the heat exchanger or tube bundle 13 may be utilized in a condensing environment. A condensing environment can arise in various ways. Generally speaking, when a water heater increases in efficiency, the temperature of the flue gas decreases and when the flue gas temperature drops below the dew point, flue gas condensation forms. This condensation is typically acidic and can damage unprotected copper or cupronickel of the type used in the manufacture of the preferred heat exchanger of the invention, as previously described. Although a number of condensate resistive polymer coatings are known which could be used to protect such heat exchangers or other copper components, they are difficult or impossible to successfully apply because naturally forming copper oxidation inhibits successful bonding of the polymer to the copper surface. Where copper oxidation forms on clean copper at room temperatures, the speed and severity of copper oxide formation is dramatically accelerated at temperatures frequently required to cure such polymers.

Successful polymer bonding requires that the copper remain clean and virtually oxide free throughout the polymer coating and curing process. Previously, this has been achieved by methods such as conducting cleaning, polymer coating and oven curing in a vacuum environment. Use of this process has been limited, however, due to the high cost, complexity and physical limitations inherent in processing in a vacuum environment. These limitations are dramatically reduced by the use of a noble metal primer to limit post cleaning oxidation before and during the polymer application process. By applying a noble metal primer surface, the copper oxidation that traditionally forms is avoided and a successful polymer to copper bond is easily achieved. Since noble metals are relatively expensive, it is significant to note that the bonding benefit can be achieved with a very thin layer, sometimes calla flash coat. The layer need only be thick enough to prevent copper oxidation from occurring during the condensate protective polymer application process. However due consideration must be given to increasing the thickness to minimize copper oxidation when there is extended dwell time between cleaning, polymer coating and curing.

The noble metal which is used to prime the exterior surface of the heat exchanger is preferably selected from the group consisting of platinum, gold, silver, electroless nickel, titanium, and alloys including Hastelloy, Inconel, Monel and Incoloy. In some embodiments of the invention, the exterior surfaces of the heat exchanger can also be anodized prior to applying the corrosion protective monomeric or polymeric topcoat. The top coat can be any suitable monomer or polymer which provides corrosion protection and which is capable of withstanding the combustion process and the acidic effects of flue gas condensate on a surface enhanced heat exchanger. A number of members of the fluropolymer family of polymers can be utilized, for example.

In one embodiment of the corrosion protection process of the invention, the copper heat exchanger receives a 0.5 mil thick primer of electroless nickel to maintain a copper oxide free surface over which a 7 to 10 mil Polytetrafluoroethylene (PTFE) condensate protective polymer is applied. The condensate protective PTFE polymer is then cured and bonded to the copper heat exchanger at approximately 700 degrees F in a high temperature curing oven.

An invention has been provided with several advantages. The finned tube water heater of the invention features a tube bundle with an integral baffle construction which eliminates the need for additional baffle components. The circular flow tube and vertical manifold arrangement provide effective cross flow of water through the assembly to facilitate heat exchange. The blower/mixing assembly is constructed of simple, easily fabricated components which simplify assembly and reduce cost. A "build up" method of assembling the blower/mixing box and associated components on the bulkhead reduces assembly costs. Costs are further reduced because the blower/mixing box achieves integral air/fuel mixing, without the use of a secondary mechanism or device. The vertical flow manifolds have oval holes with a landing area and an inward draw which allows filler metal to be assembled about the flow tube connecting ends and positioned on the landing areas. The tube bundle can then brazed as a unit in a brazing furnace to produce an ASME certifiable joint of high reliability.

The one-piece, insulating jacket performs the cosmetic function of surrounding the internal components of the device and also forms a flue collection chamber for the tube bundle. This jacket is initially restrained by a mechanical clasp which can be easily released to remove the jacket for maintenance operations on the internal components of the assembly. The frequently required flow indication device can be installed in the run of the manifold flow, thereby eliminating labor for pipe fittings downstream. A damper, interlocked with two or more independent gas circuits, can be added to the blower/mixing box inlet to form a staging mechanism to provide a low cost control scheme for two or more stage firing of the burner. A damper, electrically, optically, pneumatically or mechanically liked to a gas control valve can be added to the blower/mixing box inlet to form a low cost control scheme for maintaining the appropriate air to fuel ratio over a wide range of burner firing. The control panel and transparent cover panel provide a water resistant assembly in those cases where the water heater is exposed to the elements.

The corrosion protection process employed in some embodiments of the invention provides corrosion protection for condensing water heaters, boilers and heat exchanger components. The method introduces an oxidation inhibiting substrate preparation from a noble metal including but not limited to platinum, gold, silver, electroless nickel, and titanium, or alloys such as Hastelloy, Inconel, Monel, and Incoloy, or anodizing to preserve the heat transfer and other metallurgical properties of the base metal where the base metal includes copper, aluminum, stainless steel, mild steel and cupronickel. With the base metal preserved by the first step in the method, the base metal then easily accepts a corrosion protective monomer or polymer topcoat capable of withstanding the combustion process and the acidic effects of flue gas condensate on a surface enhanced heat exchanger.

While the invention has been shown in several of its forms, it is not thus limited but is susceptible to various changes and modifications without departing from the spirit thereof.

We claim:

1. An finned tube heat exchanger, comprising:

at least one flow manifold having a water inlet and a water outlet and a plurality of connecting openings;

a plurality of circular flow tubes arranged in stacked fashion to form a tube bundle which surrounds an initially open interior space, each flow tube having a pair of opposing connecting ends which connect to selected connecting openings provided in the at least one flow manifold;

wherein the flow tubes have external fins located on an exterior surface thereof, the external fins being crushed to form upper and lower flat stacking surfaces for stacking the tubes to form the tube bundle, the external fins also being crushed to form angled baffle surfaces about an external periphery of the tubes when the tubes are stacked to form a tube bundle.

2. The finned tube heat exchanger of claim 1, wherein the external fins which are crushed to form the angled baffle surfaces on each flow tube present a continuous exposed surface on the exterior of the tube bundle when the flow tubes are stacked in vertical fashion, the continuous exposed surface comprising an integral baffle surface for the tube bundle when the tubes are stacked with the flat stacking surfaces in contact.

3. The finned tube heat exchanger of claim 1, wherein the circular flow tubes are formed of a material selected from the group consisting of copper, aluminum, stainless steel, mild steel and cupronickel.

4. The finned tube heat exchanger of claim 3, wherein the circular flow tubes are provided with a corrosion resistant coating which is formed by priming an exterior surface of the flow tubes with a noble metal primer, followed by applying a corrosion protective monomeric or polymeric topcoat.

5. The finned tube heat exchanger of claim 4, wherein the noble metal is selected from the group consisting of platinum, gold, silver, electroless nickel, titanium, and alloys including Hastelloy, Inconel, Monel and Incoloy.

6. The finned tube heat exchanger of claim 3, wherein the circular flow tubes are provided with a corrosion resistant coating which is formed by first anodizing the tubes, followed by applying a corrosion protective monomeric or polymeric topcoat.

7. The finned tube heat exchanger of claim 1, wherein each finned flow tube is formed with a forming die which creates four facets on the exterior of each tube, two of the facets forming the stacking surfaces and two of the facets forming the baffle surface.

8. The finned tube heat exchanger of claim 1, wherein the heat exchanger is incorporated within a water heater having a burner having a burner outlet which communicates with the interior space within the stacked tube bundle for producing products of combustion for heating water flowing in the flow tubes; and wherein the angled baffle surfaces which are formed about the external periphery of the tubes serve to retain heat from the products of combustion of the burner which are released into the interior space within the stacked tube bundle.

9. The finned tube heat exchanger of claim 1, wherein the heat exchanger is incorporated within a fluid heat rejection device having a blower having a blower outlet which communicates with the interior space within the stacked tube bundle for producing an air flow in heat exchange relationship with water being cooled as it flows through the interior of the tube bundle.

10. An finned tube heat exchanger, comprising:

a pair of flow manifolds, each having a water inlet and a water outlet and a plurality of connecting openings;

a plurality of circular flow tubes arranged in stacked fashion to form a tube bundle which surrounds an initially open interior space, each flow tube having a pair of opposing connecting ends which connect to selected connecting openings provided in a selected one of the flow manifolds;

wherein the flow tubes have external fins located on an exterior surface thereof, the external fins being crushed to form upper and lower flat stacking surfaces for stacking the tubes to form the tube bundle, the external fins also being crushed to form angled baffle surfaces about an external periphery of the tubes when the tubes are stacked to form a tube bundle.

11. The finned tube heat exchanger of claim 10, wherein the external fins which are crushed to form the angled baffle surfaces on each flow tube present a continuous exposed surface on the exterior of the tube bundle when the flow tubes are stacked in vertical fashion, the continuous exposed surface comprising an integral baffle surface for the tube bundle when the tubes are stacked with the flat stacking surfaces in contact.

12. The finned tube heat exchanger of claim 10, wherein the circular flow tubes are formed of a material selected from the group consisting of copper, aluminum, stainless steel, mild steel and cupronickel.

13. The finned tube heat exchanger of claim 12, wherein the circular flow tubes are provided with a corrosion resistant coating which is formed by priming an exterior surface of the flow tubes with a noble metal primer, followed by applying a corrosion protective monomeric or polymeric topcoat.

14. The finned tube heat exchanger of claim 13, wherein the noble metal is selected from the group consisting of platinum, gold, silver, electroless nickel, titanium, and alloys including Hastelloy, Inconel, Monel and Incoloy.

15. The finned tube heat exchanger of claim 12, wherein the circular flow tubes are provided with a corrosion resistant coating which is formed by first anodizing the tubes, followed by applying a corrosion protective monomeric or polymeric topcoat.

16. The finned tube heat exchanger of claim 10, wherein each finned flow tube is formed with a forming die which creates four facets on the exterior of each tube, two of the facets forming the stacking surfaces and two of the facets forming the baffle surface.

17. The finned tube heat exchanger of claim 10, wherein the heat exchanger is incorporated within a water heater having a burner having a burner outlet which communicates with the interior space within the stacked tube bundle for producing products of combustion for heating water flowing in the flow tubes; and wherein the angled baffle surfaces which are formed about the external periphery of the tubes serve to retain heat from the products of combustion of the burner which are released into the interior space within the stacked tube bundle.

18. The finned tube heat exchanger of claim 10, wherein the heat exchanger is incorporated within a fluid heat rejection device having a blower having a blower outlet which communicates with the interior space within the stacked tube bundle for producing an air flow in heat exchange relationship with water being cooled as it flows through the interior of the tube bundle.

19. A method or corrosion protecting a finned tube heat exchanger, the method comprising the steps of:

providing a heat exchanger having:

a pair of flow manifolds, each having a water inlet and a water outlet and a plurality of connecting openings;

a plurality of circular flow tubes arranged in stacked fashion to form a tube bundle which surrounds an initially open interior space, each flow tube having a pair of opposing connecting ends which connect to selected connecting openings provided in a selected one of the flow manifolds; and wherein the flow tubes have external fins located on an exterior surface thereof, the external fins being crushed to form upper and lower flat stacking surfaces for stacking the tubes to form the tube bundle, the external fins also being crushed to form angled baffle surfaces about an external periphery of the tubes, the angled baffle surfaces on each flow tube presenting a continuous exposed surface on the exterior of the tube bundle when the flow tubes are stacked in vertical fashion which comprises an integral baffle surface for the tube bundle; and wherein the circular flow tubes are formed of a material selected from the group consisting of copper, aluminum, stainless steel, mild steel and cupronickel; and wherein the circular flow tubes are provided with a corrosion resistant coating which is formed by priming an exterior surface of the flow tubes with a noble metal primer, followed by applying a corrosion protective monomeric or polymeric topcoat.

20. The method of claim 19, wherein the noble metal is selected from the group consisting of platinum, gold, silver, electroless nickel, titanium, and alloys including Hastelloy, Inconel, Monel and Incoloy.

21. The method of claim 19, wherein the corrosion protective monomeric or polymeric topcoat is a fluropolymer.

22. The method of claim 19, wherein each finned flow tube is formed with a forming die which creates four facets on the exterior of each tube, two of the facets forming the stacking surfaces and two of the facets forming the baffle surface.

23. The method of claim 19, wherein the heat exchanger is incorporated within a water heater having a burner having a burner outlet which communicates with the interior space within the stacked tube bundle for producing products of combustion for heating water flowing in the flow tubes; and wherein the angled baffle surfaces which are formed about the external periphery of the tubes serve to retain heat from the products of combustion of the burner which are released into the interior space within the stacked tube bundle.

24. The method of claim 19, wherein the heat exchanger is incorporated within a fluid heat rejection device having a blower having a blower outlet which communicates with the interior space within the stacked tube bundle for producing an air flow in heat exchange relationship with water being cooled as it flows through the interior of the tube bundle.

* * * * *